United States Patent [19]

Hicks

[11] 4,213,611

[45] Jul. 22, 1980

[54] BODY TETHERED BALL GAME

[76] Inventor: D. Michelle Hicks, 1581 Sunnydale Ave., San Francisco, Calif. 94134

[21] Appl. No.: 902,241

[22] Filed: May 2, 1978

[51] Int. Cl.[2] ..... A63B 67/00

[52] U.S. Cl. ..... 273/414

[58] Field of Search ..... 273/95 A, 97 R, 100, 273/DIG. 19

[56] References Cited

U.S. PATENT DOCUMENTS

| | | | |
|---|---|---|---|
| 786,997 | 4/1905 | Rosenthal | 273/95 A |
| 3,224,774 | 12/1965 | Klotz | 273/DIG. 19 X |
| 3,342,482 | 9/1967 | Paolone | 273/95 A X |
| 3,764,140 | 10/1973 | Lotfy | 273/95 A |
| 3,863,924 | 2/1975 | Gagnon | 273/95 R |
| 4,021,035 | 5/1977 | O'Hara | 273/DIG. 19 X |

*Primary Examiner*—William H. Grieb
*Attorney, Agent, or Firm*—Willis E. Higgins

[57] ABSTRACT

This game has an adjustable support to be worn around the torso of a player. A resilient ball is tethered to the support with a flexible cord. The length of the flexible cord is adjustable to a suitable length for allowing the ball to be hit in a forward stroke by a person wearing the adjustable support, passed partially around the torso of the wearer and be hit in a reverse stroke. The adjustable support and the tether may be formed from a single, flexible cord with one loop for adjustment around the torso and a second loop for adjustment of the length of the tether. This game allows a single player to maintain a volley with alternate forehand and backhand strokes.

3 Claims, 4 Drawing Figures

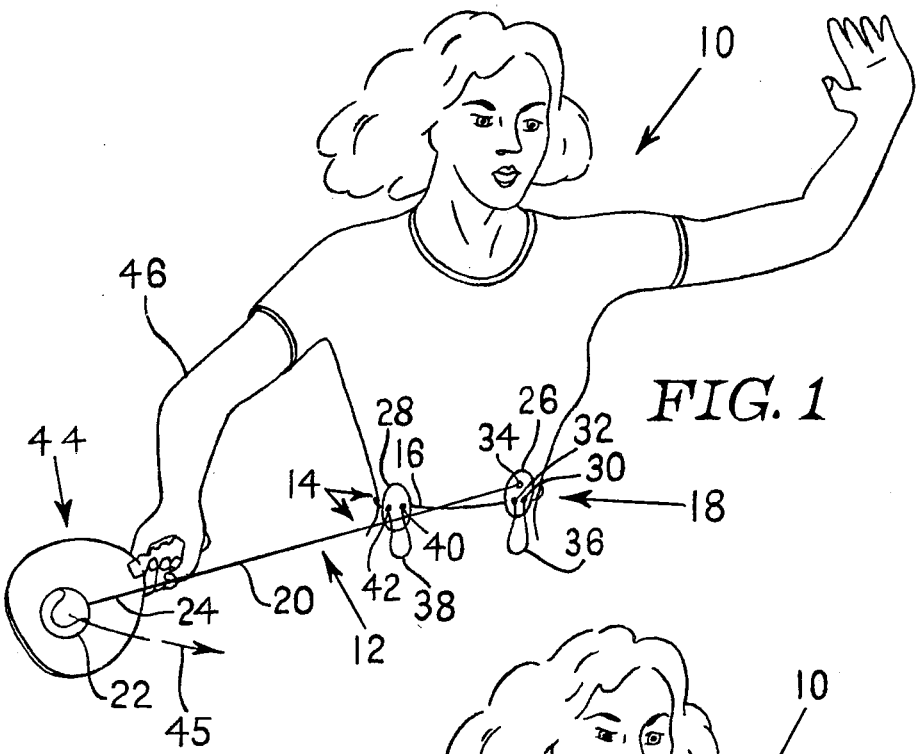
FIG. 1
FIG. 2
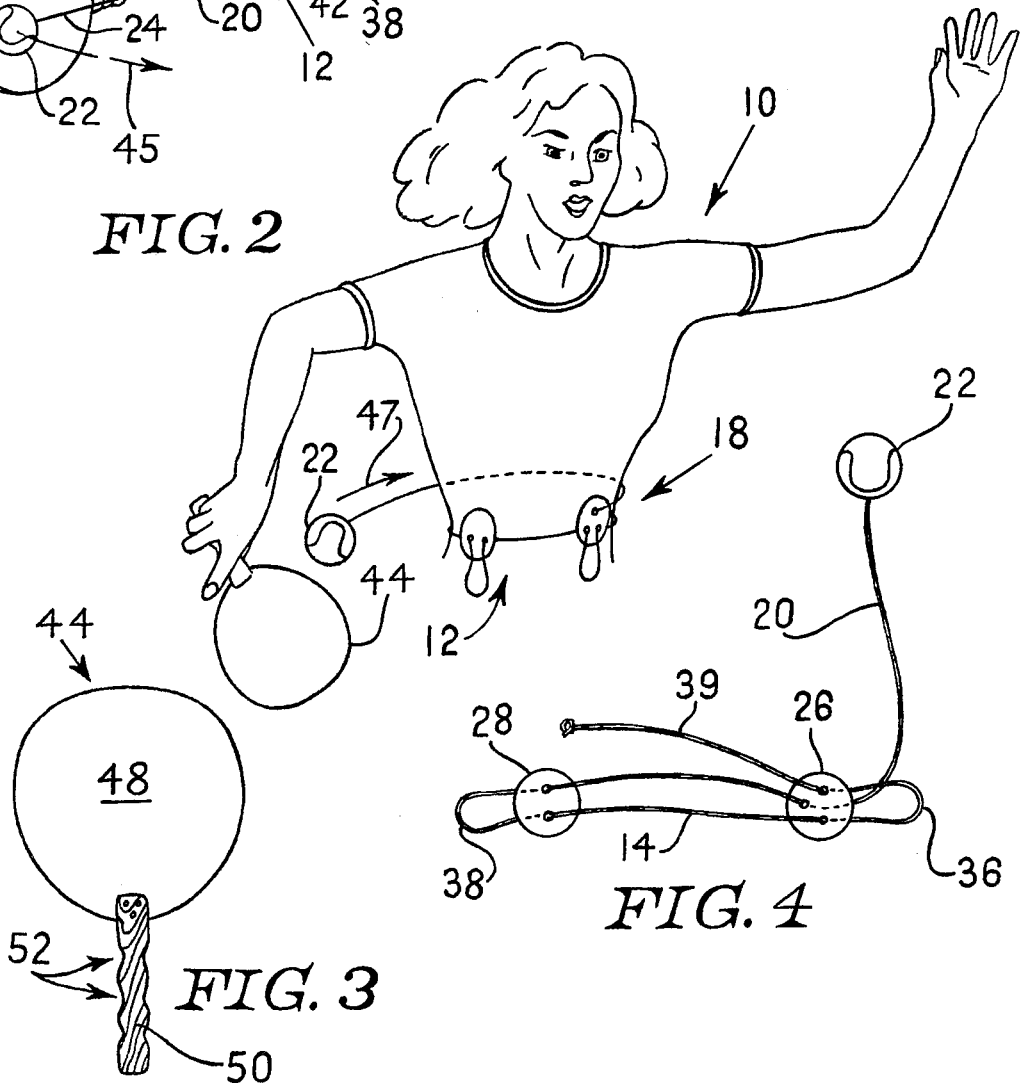
FIG. 4
FIG. 3

BODY TETHERED BALL GAME

FIELD OF THE INVENTION

This invention pertains to a tethered ball game worn around the torso of a player and playable by one person. More particularly, it relates to such a game in which a single player may utilize successive forehand and backhand strokes to produce a volley.

DESCRIPTION OF THE PRIOR ART

There are a variety of tethered ball game devices known in the art. Klotz, U.S. Pat. No. 3,224,774 discloses a device including two outwardly extending paddles, worn around the torso of a user, with a tethered ball mounted between the paddles. Oscillatory motion of the torso permits the ball to be hit back-and-forth between the paddles. Gagnon, U.S. Pat. No. 3,863,924 discloses a device worn about the torso including a target from which a tethered ball is bounced by means of oscillatory motion of the torso. Paolone, U.S. Pat. No. 3,342,482 discloses a device in which a ball mounted on a flexible rod is caused to gyrate by means of oscillation of the torso.

Tethered ball games in which a ball mounted onto a post by means of a flexible cord is struck by a paddle are also known. Such games are disclosed in, for example, Rosenthal, U.S. Pat. No. 786,997 and Lotfy, U.S. Pat. No. 3,764,140.

While the art of tethered ball games is thus a reasonably well developed one, game manufacturers continue to be interested in new game effects which are not provided in the prior art.

SUMMARY OF THE INVENTION

Accordingly, it is an object of this invention to provide a tethered ball and paddle game adapted to be worn about the torso of a player.

It is another object of this invention to provide a tethered ball game in which a person may utilize forehand and backhand strokes to maintain a volley while playing the game alone.

It is still another object of this invention to provide a game employing a tethered ball worn about the torso of a player in which both the length of the tether and the circumference of a support around the torso of a player are independently adjustable.

It is still another object of this invention to provide a tethered ball game worn about the torso of a player in which a single cord is employed to form both an adjustable length tether and an adjustable support worn around the torso of a player.

The attainment of these and related objects may be achieved through use of the novel tethered ball game herein disclosed. The game includes a support to be worn about a human torso. A resilient ball is tethered by means of a flexible cord extending from the support. The length of the tether is adjustable to a suitable length, which will vary for different individuals, and for different forms used to hit the ball, for allowing the ball to be hit in a forward stroke by a person wearing the adjustable support. The ball passes partially around the torso of the wearer, and it may then be hit in a reverse stroke to bring it back around for another forward stroke. In this manner, the ball game may be played by one person, with the object of maintaining a volley for as long as possible by alternate forward and reverse strokes. A paddle is preferably used to hit the ball.

The attainment of the foregoing and related objects, advantages and features of the invention will be more readily apparent after review of the following more detailed description of a preferred embodiment of the invention, taken in conjunction with the drawing, in which:

DETAILED DESCRIPTION OF THE INVENTION

FIG. 1 is a front view of an individual wearing the invention at the beginning of play;

FIG. 2 is a similar front view of the person, showing the device just prior to a return stroke;

FIG. 3 is a plan view of a paddle suitable for use with the invention; and

FIG. 4 is a plan view of the invention as it appears when not being worn.

Turning now to the drawings, more particularly to FIG. 1, there is shown a person 10 wearing a tethered ball game 12 in accordance with the invention. In the form shown, a single cord 14 is used to form both an adjustable support 16 around the torso 18 of the person and a tether 20, fastened to ball 22 at its end 24 remote from the support 16.

A first disc member 26 and a second disc member 28, through which the cord 14 passes, are provided, in order to make the support 16 and the tether 20 each independently adjustable as to length. If desired, only the first disc member 26 need be provided, in which case adjustment of the support 16 or the length of tether 20 cannot be accomplished without affecting the length of the other.

The first disc member 26 has three apertures 30, 32 and 34 extending through it. These apertures are dimensioned to receive cord 14 in a friction fit through them, typically such that several pounds of sustained force is required to move the cord through the apertures.

The cord 14 passes through the first aperture 30, preferably from back to front of the disc member 26. The cord 14 then forms a first loop 36 and passes back through the first disc member 26 from front to back through second aperture 32.

The cord 14 then passes around the torso 18 of person 10 and forms a second loop 38 by passing through a first aperture 40 in second disc member 28 from back to front and then through a second aperture 42 to complete the second loop 38.

The cord then passes through the third aperture 34 of first disc member 26 from back to front with the remainder of the cord forming tether 20.

In use, support 16 of the game is positioned around the torso 18, preferably with the first disc member 26 on the side of the person away from hitting arm 46 and the second disc member 28 on the same side as hitting arm 46, and adjusted for a proper fit by shortening or lengthening first loop 36. Tether 20 is then adjusted to the proper length for a forward stroke from paddle 44 by shortening or lengthening second loop 38. The length of tether 20 is adjusted to the length of the player's arm 46 plus the paddle 44 for the forward stroke. It should be noted that there can be some variation in this length, depending on how straight the arm 46 is at the time of the forward stroke. Since the first loop 36 is used to adjust the length of support 16 and the second loop 38 is used to adjust the length of tether 20, each of these lengths can be adjusted independently, without changing the other length. If only the first loop 36 is provided, adjustment of these two lengths can also be accomplished, but not independently of each other. If desired, the loops 36 and 38 can be pulled taut against apertures 30 and 32 and 40 and 42, respectively, after the adjustments have been completed, by increasing the length of portion 39 of cord 14 (shown in FIG. 4). Portion 39 may then be wound around either disc 26 or 28 to avoid tangling.

While cord 14 may be made of any flexible material having a suitable strength, it is preferably a flexible wire covered with plastic. Disc members 26 and 28 may then be made of any suitable plastic material, such as polyethylene or the like. Ball 22 is typically made of rubber or a suitable resilient plastic.

In use, after adjusting the length of support 16 using first loop 36 and the length of tether 20 using second loop 38, play is initiated by throwing ball 22 toward paddle 44 and hitting the ball 22 sharply with paddle 44 in a forward stroke, as shown in FIG. 1. The ball 22 is preferably thrown so that tether 20 is taut at the time ball 22 is first hit by paddle 44. Ball 22 then passes around torso 18 in a generally circumferential manner, as shown by arrows 45, to the position shown in FIG. 2. A backhand stroke is then provided with the paddle 44, as shown in FIG. 2, to cause ball 22 to reverse its direction of travel, as indicated by arrow 47, and return to the position shown in FIG. 1 for another forward stroke. Such a volley of alternate forward and backhand strokes is then continued for as long as possible.

Since the motion of the ball 22 around and back around the torso 18 occurs quite rapidly, some practice with the game may be required in order to be able to sustain a volley at first. As a player's level of skill increases, the game might be varied by shifting the paddle 44 from one hand to the other, using alternate forward strokes with each hand to reverse the direction of travel of ball 22. Also, more skilled players may wish to utilize a stringed racket in place of paddle 44 for faster action. Of course, the game can be played with either the right or the left arm used to hit the ball.

FIG. 3 shows a preferred form of paddle 44 for use with this game. While paddle 44 is generally similar to a ping pong paddle, it is preferred to make its ball contacting surface 48 more rounded in shape on its sides than a conventional ping pong paddle, since there is no table employed with this game. Grip 50 is also desirably more rounded than a conventional ping pong paddle handle, and it also may be shaped as shown at 52 for better grip by the fingers of a user.

It should now be apparent that a novel ball game capable of achieving the stated objects of the invention has been provided. Unlike other tethered ball games worn about the torso of a player, this game relies on good hand-eye coordination and preferably use of a paddle or the like, rather than oscillation of the torso, to impart motion to the ball. The support of the game is easily adjusted for different individuals, as is the length of the tether. In the preferred form shown, both the support and the tether are formed from a single cord, with the length of the support and the tether each being independently adjustable.

It should further be apparent that various changes in the form and details of the invention may be made, while retaining its essential characteristics. For example, the disc members 26 and 28 may be provided with a different arrangement of apertures through them. It is intended that such changes in form and detail be included within the scope of the claims appended hereto.

What is claimed is:

1. A ball game, which comprises:

a resilient ball, and an adjustable support be worn about a human torso, said adjustable support comprising a cord and a member having three apertures extending therethrough dimensioned to receive the cord in a friction fit, the cord passing through a first one of said apertures in a first direction, forming a loop and passing through a second one of the apertures in the opposite direction, forming a second loop to fit around the torso of a wearer, then passing through the third aperture in the first direction, the remainder of the cord after passing through the third aperture constituting a flexible tether attached at its end remote from said apertured member to said resilient ball, the length of said flexible tether being adjustable to a suitable length for allowing said resilient ball to be hit in a forward stroke by a person wearing said adjustable support, pass partially around the torso of the person, and be hit in a reverse stroke.

2. The ball game of claim 1 in which a second member having first and second apertures therethrough dimensioned to receive the cord in a friction fit is mounted on the portion of the cord constituting the second loop, the cord passing through the first aperture in a first direction and the second aperture in a second direction to form a third loop, the first and third loops providing an independent ability to adjust the length of the second loop and the length of the tether extending from said first member.

3. The ball game of claim 2 in which the length of said flexible tether is adjusted to a length suitable for allowing said ball to be hit in a forward stroke with a paddle and be hit in a backhand stroke by the same arm used to make the forward stroke.

* * * * *